United States Patent [19]

Seymour

[11] Patent Number: 4,869,784

[45] Date of Patent: Sep. 26, 1989

[54] CONTROLLING WATER INPUT TO PULP WASHING SYSTEM BASED ON MEASUREMENTS ON REDUCED DIMENSION STREAM

[76] Inventor: George W. Seymour, 2841 Parkwood Dr., Brunswick, Ga. 31520

[21] Appl. No.: 170,298

[22] Filed: Mar. 21, 1988

[51] Int. Cl.[4] ..... D21C 9/00

[52] U.S. Cl. ..... 162/49; 162/50; 162/60; 162/61; 162/DIG. 10

[58] Field of Search ..... 162/258, 49, 50, 60, 162/61, DIG. 10; 68/181 R; 8/156

[56] References Cited

U.S. PATENT DOCUMENTS

| | | | |
|---|---|---|---|
| 4,046,621 | 9/1977 | Sexton | 162/40 |
| 4,096,028 | 6/1978 | Rosenberger | 162/49 |
| 4,207,141 | 6/1980 | Seymour | 162/49 |
| 4,662,991 | 5/1987 | Kärnä et al. | 162/49 |
| 4,735,684 | 4/1988 | Seymour | 162/49 |

FOREIGN PATENT DOCUMENTS 1203407 4/1986 Canada .

OTHER PUBLICATIONS

Perkins, J. K., "Brown Stock Washing Using Rotary Filters", pp. 1–17, 19–23, 25–31, 33–37, 39–43, 45–51, 53–55, TAPPI PRESS (undated).

Sande, W. E. et al., Tappi Journal, Mar. 1988, pp. 93–97.

Tappi Journal, Feb. 1988, p. 199 and opposite side.

*Primary Examiner*—Peter Chin

*Assistant Examiner*—Thi Dang

[57] ABSTRACT

Wash water input into a pulp washing system is controlled in response to measurements on a stream of output constituents of reduced transverse dimension compared to the transverse dimension of the washed pulp mat discharge stream from the pulp washing system. The measurements are conducted simultaneously across the entire width of the reduced dimension stream on all the washed pulp and water leaving the pulp washing system. The measurements are readily carried out using apparatus including means below said reduced dimension stream.

18 Claims, 2 Drawing Sheets

CONTROLLING WATER INPUT TO PULP WASHING SYSTEM BASED ON MEASUREMENTS ON REDUCED DIMENSION STREAM

TECHNICAL FIELD

The present invention relates to a method of controlling the wash water input into a cellulosic pulp washing system.

BACKGROUND OF THE INVENTION

A typical countercurrent pulp slurry washing system is depicted in FIG. 1 of Seymour U.S. Pat. No. 4,207,141 and is described at column 4, line 65 to column 6, line 2 of that patent and this depiction and description is incorporated herein by reference.

In this kind of system, the most commonly used method for controlling the amount of fresh wash water introduced via wash sprayer 1 of said FIG. 1 (i.e., into the last stage of the countercurrent operation) comprises measuring the percent solids in the wash liquor in the first stage filtrate tank (denoted 8'' in said FIG. 1) normally on an hourly basis and controlling the amount of water introduced via said wash sprayer to obtain a target value for the percent solids in said first stage filtrate tank. Conventionally, the operator of the system also uses his knowledge of rate of pulp flow entering the system to adjust the flow rate to said spray washer 1 when changes in pulp entry rate occur. In stages different from the last stage, i.e., in the stages containing wash sprayers 1' and 1'' in said FIG. 1, the flow rates through said sprayers are adjusted so as to maintain a relatively constant level in the filtrate tanks feeding said sprayers. This conventional method has the disadvantage that the system can contain excessive water in the takeoff stream to the evaporator and excessive water in the output stream which is required to be removed to a sewer, without detection. This is because an overwash part of the time cannot make up for an insufficient wash during another part of the time.

In another method for controlling the amount of fresh wash water introduction in said pulp washing process, conductivities in recirculating streams are measured and the fresh water introduction into the last stage (i.e., the shower flow rate via said sprayer 1) is adjusted to maintain a target value for each conductivity. This method is described in Rosenberger U.S. Pat. No. 4,096,028 and Sexton U.S. Pat. No. 4,046,621. A deficiency in this method is that accuracy depends on precise measurement of sodium ion content and conductivities are affected not only by sodium ion content but other ions present. Another defect in this method is that a change in dilution factor requires a substantial time period to effect a change in conductivity.

In another method for controlling the amount of fresh water introduction in said pulp washing process which is described in Canadian Patent No. 1,203,407, load on the washer drive mechanism is measured in an attempt to obtain a value proportional to the demand for wash water. This method has the deficiency that load on the drive mechanism depends on factors in addition to the amount of wash water required for a given dilution factor.

Still another method for controlling the amount of fresh wash water introduction into said pulp washing process is described in Seymour U.S. Pat. No. 4,207,141. In this method dielectric properties are measured in the pulp mat leaving the washing process to determine the total mass or its water content and wash water introduction is controlled in response to said determination. One problem in using this method is that available dielectric property measuring apparatus only measure such properties over 2 to 5 inches and the pulp mat leaving the process is normally 20–32 feet wide. Thus practicalities require measuring on preselected "sample" areas using stationary apparatus or on changing "sample" areas using apparatus which is reciprocated across the width of the mat. Such sampling does not give a total picture. Furthermore, a difficulty in using capacitance measuring means or microwave cavity perturbation means to conduct the capacitance measurements is in locating a capacitance electrode plate or microwave detection means below the mat. While use of a backscattered nuclear radiation device overcomes this difficulty and produces excellent results, the practical requirement for sampling referred to above and the fact that such apparatus does not detect radiation which is not backscattered means that efficiency of control could be improved.

SUMMARY OF THE INVENTION

It has been discovered herein that a more responsive and accurate wash water control method for a pulp washing operation which does not introduce the inaccuracies stemming from controlling substantially only in response to first stage consistency measurements or from measuring of conductivities or from attempting to correlate with data on samples, involves determining weight of total output constituents and/or weight of water output constituent simultaneously along the entire width of a stream of output constituents of reduced transverse dimension compared to the transverse dimension of the washed pulp mat discharge stream emanating from the last stage vacuum filter drum, i.e., the discharge stream designated by arrow 16 in FIG. 1 of U.S. Pat. No. 4,207,141, in circumstances such that measuring apparatus is readily positioned both above and below the reduced dimension stream.

The term "transverse dimension" is used herein to mean the dimension of a stream of washed pulp and water output constituents from a pulp washing process measured in a cross flow direction, i.e., in a direction perpendicular to the feed or flow direction in a plane in said stream. Where such dimension varies, apparatus is positioned to enable measurement of the maximum transverse dimension encountered.

In particular, the method herein is directed to controlling the rate of wash water introduction to achieve a desired dilution factor in a pulp washing process wherein cellulosic pulp slurry is continuously introduced and wash water is continuously introduced to wash the cellulosic pulp in said slurry to produce a washed pulp mat discharge stream having a transverse dimension and consisting essentially of washed pulp and water.

In its broad aspects, the method herein comprises the steps of (a) converting said discharge stream to a stream of the washed pulp and water constituents thereof which has a reduced transverse dimension compared to said discharge stream;

(b) continuously measuring simultaneously over said whole transverse dimension of said reduced dimension stream to determine a weight per unit length or a weight per unit volume of said reduced dimension stream and/or of water constituent thereof and determining the flow rate of said reduced dimension stream in length per unit time or volume per unit time, to determine washed pulp flow rate and water flow rate in weight per unit time corresponding to that in said washed pulp mat discharge stream;

(c) controlling fresh wash water introduction into the pulp washing process in relation to said determined washed pulp flow rate and said determined water flow rate and the desired dilution factor.

All the washed pulp and water leaving the pulp washing process are included in the measurements.

The water introduced to obtain a given dilution factor is calculated by multiplying the dilution factor by the determined washed pulp flow rate and adding the determined water flow rate. The desired dilution factor is selected by the operator on the basis of how clean the pulp is in the cellulosic pulp slurry being introduced into the pulp washing process and by balancing the product cleanliness desired, the evaporation costs of evaporting water in the filtrate removed from the process in the first stage and the cost of disposing of water required to be removed from the product effluent.

We turn now to the process in somewhat more detail.

Step (a), i.e., the step of converting the washed pulp mat discharge stream which ordinarily has a transverse dimension of 20 to 32 feet to a stream of the washed pulp and water constituents thereof and having a reduced transverse dimension compared to said discharge stream is ordinarily carried out to produce a stream having transverse dimension ranging from about 6 inches to about 40 inches, preferably from about 12 inches to about 24 inches.

In one embodiment, step (a) is readily carried out, for example, by feeding said discharge stream into a container serviced by a screw conveyor which in turn feeds to a chute which in turn continuously deposits the constituents of said discharge stream on a conveyor belt moving in timed relation with said discharge stream. The outlet of the chute is readily dimensioned to deposit a stream of the desired reduced dimension on the conveyor belt.

In a second embodiment, step (a) is carried out, for example, by introducing the washed pulp mat discharge stream into container serviced by a screw conveyor which in turn feeds the constituents of said mat into the inlet of a pump which continuously forces said constituents into a pipe of reduced transverse dimension compared to said mat to produce said reduced dimension stream flowing in said pipe.

The process herein is readily carried out by carrying out of step (b) to measure weight of the total mass of the constituents in the reduced dimension stream or to measure the mass of the water constituent in the reduced dimension stream or to make both these measurements.

In the case where a reduced dimension stream is deposited on a moving conveyor belt, the weight measurements are carried out to determine weight per unit length of stream, and the belt speed is relied on to determine speed of the stream in length per unit time (since the stream speed and belt speed correspond) and multiplication gives weight per unit time. The belt speed is readily determined by setting the belt speed at a constant value or by measuring the rate at which the belt is driven by its drive pulley.

In the case where a reduced dimension stream is pumped through a pipe, the weight measurements are carried out to determine weight per unit volume (density or specific gravity), and the flow rate of the stream through the pipe is determined by measuring to determine volume flow rate (volume per unit time) and multiplication gives weight per unit time. The volume flow rate of the stream through the pipe is readily carried out by conventional apparatus useful to determine flow rates in pipes. For example, magnetic flow meters and meters relying on the doppler effect (these instruments send a sound wave into the pipe and measure the change in frequency due to the flow rate in the pipe) are useful.

Total mass flow rate (weight per unit length or length per unit volume of the reduced dimension stream) is readily determined using, for example, a weighing device or a gamma gauge. A weighing device is used by positioning it to support a portion of reduced dimension stream passing thereover to continuously provide weight readings. A gamma gauge includes means for discharging gamma rays in the direction of one surface of the stream and a receiver/counter positioned in relation to an opposite surface of the stream to provide data on the gamma rays passing through the stream and this data is readily correlated with total mass flow rate.

In the case where a reduced dimension stream is deposited on a conveyor belt, a weighing device is readily used by positioning it to support a section of the conveyor belt along its entire width and any load thereabove in the manner that weighing devices have been used to provide weight readings in respect to material on the belt for other applications. A zero point is established by running the belt with zero loading over the weighing device so readings are provided directly of mass flow on the belt. Weight per unit length is determined by dividing the weight measured by the length of the belt/stream supported on the weighing device. The weighing device can be further calibrated by measurements involving known loads if desired.

In the case where a reduced stream is pumped through a pipe, a weighing device is readily utilized to determine total mass flow rate of said stream (weight per unit volume) by including a horizontal loop in said pipe and positioning the weighing device to support said loop in the manner that weighing devices have been used to determine densities or specific gravities of compositions flowing within pipes in other applications.

When a gamma gauge is used, the support for the reduced dimension stream (the conveyor belt or pipe) is also positioned between the portion of the device emitting gamma rays and the portion of the device receiving/counting gamma rays passing through said stream and a device or plurality of devices is used to obtain data simultaneously over the whole transverse dimension of the reduced dimension stream. Said support for the reduced dimension stream should not be of gamma ray impermeable material. In the embodiment where a pipe is used, such pipe is preferably of fiberglass or plastic or other substantially gamma ray permeable material and is preferably rectangular in cross section to provide a stream of constant transverse dimension throughout its depth.

In the embodiment where a pipe is used in transporting the reduced dimension stream, another method of determining total mass flow of the reduced dimension stream includes providing a bend in the pipe and measuring the torque at the bend caused by flow in the pipe and correlating torque with mass flow rate.

Flow rate (weight per unit length or weight per unit volume) of water constituent in the reduced dimension stream is readily determined by measuring the capacitance in a selected length or volume of said reduced dimension stream (e.g. by use of a capacitance measuring device with plates positioned on both sides of the stream or a microwave cavity perturbation apparatus with a microwave source positioned to direct microwaves at one surface of the stream and a receiver/counter positioned opposite the other surface to monitor the microwaves passing through the stream) or by use of a neutron gauge which is adapted to discharge neutrons in the direction of the reduced dimension stream and includes a receiver/counter on the opposite side of the stream to receive neutrons passing therethrough. In each case, the measurements are taken along the entire width of the stream. The capacitance measurements are readily correlated with water flow rates (weight per unit length or weight per unit volume) in the reduced dimension stream.

In a preferred method herein, total mass flow rate (weight per unit length or weight per unit volume) is determined for said reduced dimension stream by use of a weighing device or a gamma gauge or a torque measuring device, and flow rate (weight per unit length or weight per unit volume) of water constituent in said reduced dimension stream is determined based on measurement of capacitance or use of a neutron gauge, and washed pulp flow rate is determined by subtraction of the determined water flow rate from the determined total mass flow rate. A very preferred method herein relies on a gamma gauge to determine total mass flow rate of the reduced dimension stream and a neutron gauge to determine flow rate of water constituent thereof. An instrument is commercially available to carry out this very preferred method and is sold under the name Moistart® 5000 by the Ohmart Corporation of Cincinnati, Ohio. This instrument contains an internal computer which subtracts the water flow measurement from the bulk flow measurement to provide readings directly of washed pulp flow rate.

While it is preferred herein to make measurements both on weight per unit length or weight per unit volume of said reduced dimension stream and on water constituent thereof, either of these measurements will suffice to provide benefits of the invention herein. In the cases where only one of these measurements is carried out, determination of both washed pulp flow rate and also of water flow rate in said reduced dimension stream can be effected by relying on consistency (percentage of pulp) in the reduced dimension stream determined based on obtaining samples from the washed pulp mat discharge stream or reduced dimension stream and determining the consistency in the samples (e.g. by weighing a sample, then drying it to remove water, weighing the dried sample and dividing the weight after drying by the weight before drying to obtain the consistency) or by utilizing measurements on pulp inlet rate in the cellulosic pulp slurry entering the washing process and equating the washed pulp flow rate to the measured flow rate.

When measurements are made to determine total mass flow rate in the reduced dimension stream and reliance is placed on consistencies, washed pulp flow rate is determined by multiplying the determined total mass flow rate by the consistency, and water flow rate is determined by subtracting this washed pulp flow rate from said total mass flow rate; the water to be introduced into the washing process to obtain a particular dilution factor is readily calculated using the equation:

$$A=(D.F.-1)\times(T\times C)+T$$

where A is the rate of fresh water introduction into the washing system, D.F. is the dilution factor, T is the total mass flow rate and C is the consistency.

When measurements are made to determine total mass flow rate in the reduced dimension stream and reliance is placed on measurement of pulp inlet rate, the washed pulp flow rate is equated to the pulp inlet rate and water constituent flow rate is determined by subtracting the washed pulp flow rate determined in this way from the total mass flow rate.

When measurements are made to determine water flow rate in the reduced dimension stream and reliance is placed on consistencies, washed pulp flow rate is determined by first determining total mass flow rate by dividing the determined water flow rate by 1 minus the consistency and then subtracting the water flow rate from the total mass flow rate; the water to be introduced into the washing process to obtain a particular dilution factor is readily calculated using the equation:

$$A=W+(D.F.\times W\times C)/(1-C)$$

where A is the rate of fresh water introduction into the washing system, W is the water flow rate determined, D.F. is the dilution factor and C is the consistency.

When measurements are made to determine water flow rate in the reduced dimension stream and reliance is placed on pulp inlet rate, the water flow rate is known from said determination and the washed pulp flow rate is equated to the pulp inlet rate.

When reliance is to be placed on measurement of consistencies in the washed pulp mat discharge stream or reduced dimension stream, it is noted that the consistency of a pulp and water mixture leaving a washing system is fairly consistent and a few laboratory tests of the prevailing consistency over the normal range of production rates will suffice to provide consistency values for use as described above. These tests can be repeated once or twice per month to confirm or correct the consistency values relied on.

BRIEF DESCRIPTION OF THE DRAWINGS

The foregoing objects, features, and advantages of the invention will be more fully understood upon a consideration of the following detailed description of preferred forms of the invention, together with the accompanying drawings, in which.

DETAILED DESCRIPTION

Figure 1:
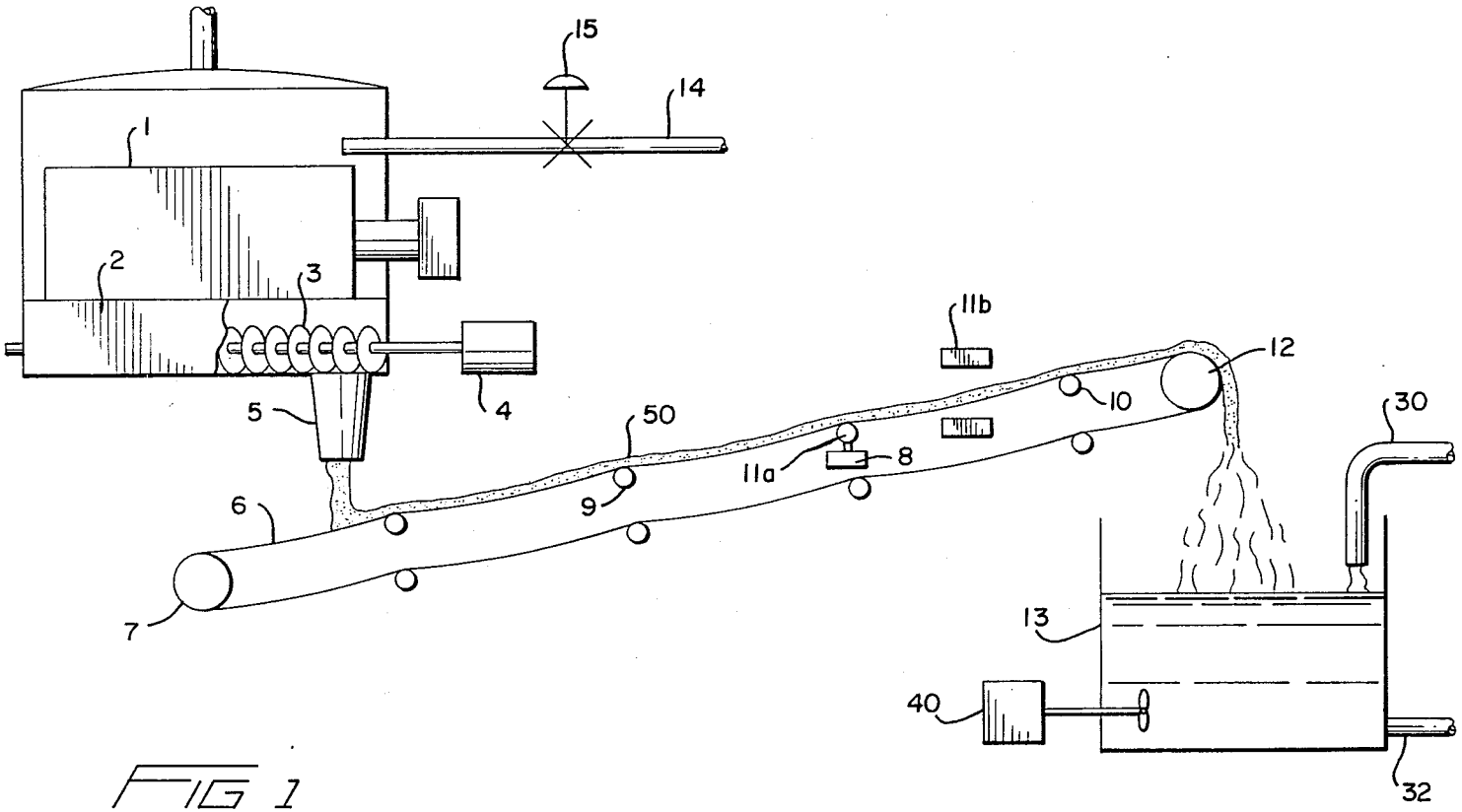
FIG. 1 is a flow schematic of the discharge end of a pulp washing process followed by a conveyor belt to the next unit in the operation and illustrates the embodiment of the invention where the reduced dimension stream is deposited on a conveyor belt.

Turning firstly to the embodiment of FIG. 1 herein the washed pulp mat discharge stream (24 feet wide) leaving the last operation in a countercurrent washing process leaves last stage vacuum filter drum 1 and is discharged into screw conveyor 2 (which is shown with part of the casing broken away to depict its screw member 3 which is driven by a motor gear assembly 4). In the screw conveyor 2, said discharge stream is broken up and mixed and conveyed by screw 3 wherein its washed pulp and water constituents are transported as an admixture into a chute 5. The admixture falls by gravity through chute 5 and is deposited as an 18 inch wide, 3 inch deep stream 50 on a conveyor belt 6 that is trained on and driven by a drive pulley 12 in timed relation to said washed pulp mat discharge stream. The belt 6 is also trained on a lower belt idler pulley 7 which is adjustable to maintain proper belt tension. The belt 6 is also supported on a number of additional pulleys (two of these are denoted 9 and 10) including a stationary pulley 11*a* which is supported on a weighing device 8. The belt 6 carries the washed pulp/water admixture 18 inch wide stream 50 deposited thereon by chute 5 to storage tank 13 equipped with mixing means 40 where said admixture may be diluted via pipe 30 and is discharged to further processing via outlet pipe 32. As the washed pulp/water admixture stream 50 on belt 6 is carried from where it is deposited by chute 5 to tank 13, it passes over the weighing device 8 that is the sole support for the belt between pulleys 9 and 10. After excluding the weight of the pulley 11*a* and belt 6 by calibrating of device 8 with no pulp or water thereon, the effective weight of the pulp/water admixture determined by device 8 is one half the weight of the pulp-/water admixture in the stream 50 on the belt between pulleys 9 and 10 whereby total weight of the stream 50 per unit length is determined. A plurality of capacitance measuring devices 11*b* are positioned in alignment transversely of belt 6 with plates on both sides of belt 6 extending across the entire width of stream 50 to measure the capacitance of said stream 50. The capacitance measuring devices 11*b* are used to determine water flow rate of water constituent of stream 50 in weight per unit length. Weight per unit length is translated into weight per unit time by multiplying by the belt speed. The flow rates of washed pulp in stream 50 is determined from the determined total mass flow rate and determined water flow rate by difference. The pulp washing process referred to hereinbefore includes a fresh water inlet pipe 14 which is to introduce wash water into the last washing stages as described hereinbefore. Pipe 14 is equipped with a valve 15. The fresh wash water introduced via pipe 14 is controlled by valve 15 in response to said determinations of washed pulp flow rate and water flow rate in stream 50 to produce a desired dilution factor.

Alternatively weighing device 8 is omitted and reference numeral 11*b* represents a Moistart® 5000 sensor as hereinbefore described which extends across the entire width of stream 50. Washed pulp flow rate and water flow rate data for the stream 50 are read directly from the instrument. Where belt 6 is always run at the same speed the instrument can be calibrated to provide readings in weight per unit time. Otherwise, the readings are converted to a weight per unit time basis by multiplying by belt speed. As in the above paragraph, the fresh water introduced via pipe 14 is controlled by valve 15 in response to the determinations of washed pulp flow rate and water flow rate in stream 50 to produce a desired dilution factor.

In still another embodiment device 11*b* is left out and mass flow rate of stream 50 is determined by relying on measurements with weighing device 8, and washed pulp flow rates and water flow rates in stream 50 are determined therefrom by calculations relying on consistencies established by determination on samples from outlet admixture from the washing operation or from stream 50 and valve 15 is controlled in response to said washed pulp flow rates and water flow rates.

In yet another embodiment device 8 is left out and the flow rate of water constituent of stream 50 is determined by relying on measurements of capacitance measuring device 11*b*. The flow rate of washed pulp constituent is determined relying on said water flow determination and calculations relying on consistencies established by determination on samples from outlet admixture from the washing operation or from stream 50, and valve 15 is controlled in response to said washed pulp flow rates and water flow rates.

Figure 2:
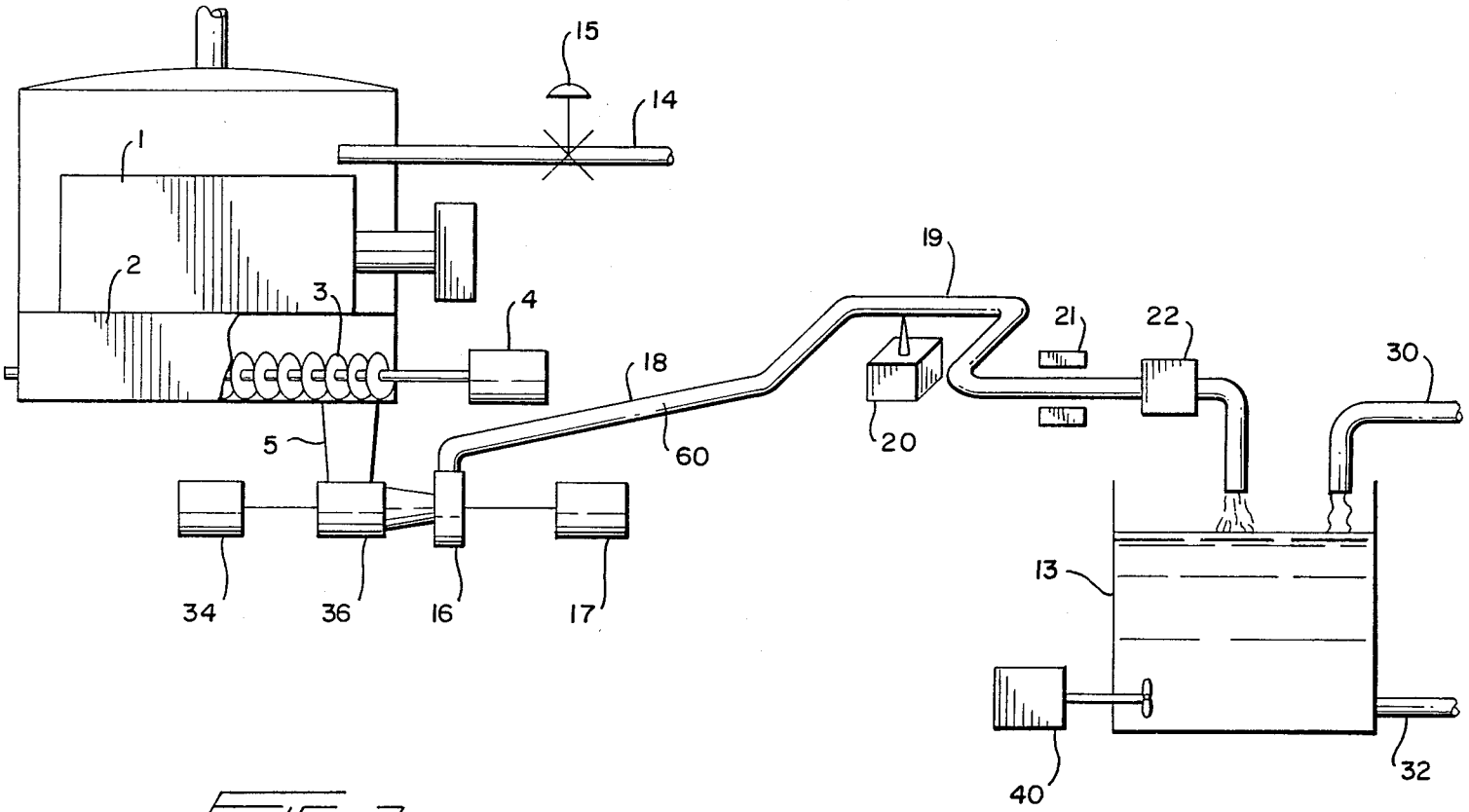
FIG. 2 is a flow schematic of the discharge end of a pulp washing process that is followed by a pump and piping to the next unit in the operation and illustrates the embodiment of the invention where the reduced dimension stream flows through and is supported in a pipe.

We turn now to the embodiment of FIG. 2. The description in reference to reference numerals 1, 2, 3, and 4 is the same as for FIG. 1. Washed pulp/water admixture falls by gravity through a chute 5 into a screw feeder 36 which is driven by a motor 34. The feeder 36 introduces the admixture into the inlet of pump 16 which is driven by a motor 17. The pump 16 is preferably a high shear medium consistency pump or thick stock pump. The pump 16 forces said admixture into a pipe 18 which is rectangular with a width of some 20 inches and a height of some 4 inches at the points of measurements of stream 60 of the washed pulp and water constituents of the pulp mat discharge stream from the drum 1 of the washing operation which is formed in pipe 18 and moved through pipe 18 to storage tank 13 which contains an outlet 32 and is equipped with an agitator 40 and wherein the admixture may be diluted with water via pipe 30. The pipe 18 contains a loop 19 which is supported on weighing mechanism 20. Preferably, the loop 19 is isolated from the rest of pipe 18 by flexible couplings. The device 20 continuously measures the weight of stream 60 in loop 19 and provides a reading of weight of stream 60 per unit volume. A magnetic flow meter 22 is included in pipe 18 to continuously measure the flow rate of stream 60 through pipe 18 in volume per unit time. Multiplication of the flow rate as determined by meter 22 by the weight per unit volume determined by weighing device 20 gives the flow rate in weight per unit time of stream 60. Positioned in transverse alignment along the entire width of pipe 18 and stream 60 are a plurality of capacitance measuring devices 21 having one portion above the pipe and a second portion below the pipe whereby the capacitance of stream 60 is measured to provide weight per unit volume (density) data on the water constituent of stream 60 and this is multiplied by the volume flow rate as determined by meter 22 to give flow rate of water constituent of stream 60 in weight per unit time. The flow rate of washed pulp constituent of stream 60 in weight per unit time is determined by subtracting the water flow rate from the total mass flow rate. As in the process of FIG. 1, the pulp washing process includes a fresh water inlet pipe 14 which is to introduce wash water into the last washing stage. Pipe 14 is equipped with a valve 15. The fresh wash water introduced via pipe 14 is controlled by valve 15 in response to the aforedescribed determination of washed pulp flow rate and water flow rate in stream 50 to produce a desired dilution factor.

In an alternative process weighing device 20 is left out and a Moistart® 5000 sensor is substituted for the capacitance measuring device 21 across the entire width of pipe 18 to provide weight per unit volume data for washed pulp constituent of stream 60 and for water constituent of stream 60. The weight per unit of volume figures are translated to weight per unit time rates by multiplication by flow rate data from meter 22 thereby to provide mass flow rates in weight per unit time of washed pulp constituent of stream 60 and water constituent of stream 60, and the fresh wash water introduced via pipe 14 is controlled by valve 15 in response to the washed pulp and water flow rates determined for stream 60 to produce a desired dilution factor.

In similar fashion to what is described in conjunction with FIG. 1 in other variations in respect to FIG. 2 fresh wash water introduced via pipe 14 is controlled via valve 15 in response to measurements to provide data for determination of total mass flow in stream 60 or of water constituent thereof and reliance on consistencies determined as described in conjunction with FIG. 1 or on washed pulp flow equated to pulp inlet rate into the washing system.

Variations will be evident to those skilled in the art. For example, while the present invention has been described in the context of a basic brown stock pulp washing operation for washing cellulose, it may be applied to a variety of operations such as a bleach plant washing step, a diffusion type washer, or a fourdrinier type washer. Moreover, when capacitance measuring means are utilized, it may be considered desirable to utilize multiple frequencies rather than a single frequency to enhance the accuracy. Furthermore, while no temperature compensation has been specifically described in relation to capacitance measurement, it will be understood that temperature compensation should be carried out as would be understood by those skilled in the capacitance measuring art.

Therefore, the scope of the invention is intended to be defined by the claims.

What is claimed is:

1. A method for controlling the continuous washing of cellulosic pulp comprising the steps of:

(a) continuously introducing wash water into a continuous stream of a pulp slurry mat to produce a mixture consisting essentially of wash water and said pulp slurry mat;

(b) discharging said mixture in a discharge stream having a transverse dimension;

(c) reducing said transverse dimension of said discharge stream;

(d) determining a weight per unit length or a weight per unit volume of said reduced dimension stream or a weight per unit length or a weight per unit volume of the water constituent in said reduced dimension stream;

(e) determining from the rate of movement in length per unit time or the volume per unit time of said reduced dimension stream and said weight per unit length or said weight per unit volume, a weight flow rate of said reduced dimension stream or a weight flow rate of the water constituent in said reduced dimension stream;

(f) adjusting the amount of the wash water introduced into said pulp slurry mat to a predetermined dilution factor in response to said determined weight flow rate.

2. The process of claim 1 wherein said reduced dimension stream has a transverse dimension ranging from about 6 inches to about 40 inches.

3. The process of claim 2 wherein step (c) comprises feeding said discharge stream to means for continuously feeding the washed pulp and water constituents thereof through a pipe to provide a stream in said pipe of said constituents having a transverse dimension ranging from about 12 inches to about 24 inches.

4. The process of claim 3 wherein the step (d) comprises simultaneously measuring over the whole of the transverse dimension of the reduced dimension stream to determine the weight per unit volume of said reduced dimension stream either by including in said pipe a horizontal loop and using a weighing means supporting said horizontal loop or by use of a gamma gauge including gamma ray discharge means which discharges gamma rays in the direction of the reduced dimension stream in said pipe and including means to receive and count gamma rays passing through said stream and step (e) comprises measuring the flow rate of said stream in said pipe to determine flow rate of said stream in volume per unit time.

5. The process of claim 4 wherein step (d) also comprises measuring to determine the weight per unit volume of said water constituent in said reduced dimension stream by measuring the capacitance in a selected volume of said reduced dimension stream in said pipe or by using a neutron gauge which discharges neutrons in the direction of the reduced dimension stream in said pipe and includes a means to receive and count neutrons passing through said stream.

6. The process of claim 5 wherein step (d) comprises measuring to determine the weight per unit volume of said reduced dimension stream by using said gamma gauge and measuring to determine the weight per unit volume of the water constituent in said reduced dimension stream using a neutron gauge.

7. The process of claim 4 wherein in step (e) either (A) washed pulp flow rate and water flow rate are determined from reduced dimension stream flow rate in weight per unit time and consistency determined based on obtaining samples from said discharge stream or from said reduced dimension stream or from said discharge stream and said reduced dimension stream and measuring the consistency in said samples, or (B) washed pulp flow rate is determined by measurement of pulp inlet rate and equating the washed pulp flow rate to the measured pulp inlet rate, and water flow rate is determined from said reduced dimension stream flow rate and the washed pulp flow rate.

8. The process of claim 3 wherein step (d) comprises simultaneously measuring over the whole transverse dimension of the reduced dimension stream to determine the weight per unit volume of said water constituent in said reduced dimension stream by measuring the capacitance in a selected volume of said reduced dimension stream or by using a neutron gauge, and step (e) comprises (i) measuring to determine the flow rate of said reduced dimension stream in volume per unit time and determining water flow rate in weight per unit time and (ii) determining washed pulp flow rate in weight per unit time either from said water flow rate in weight per unit time and consistency determined based on obtaining samples from said discharge stream or from said reduced dimension stream or from said discharge stream and said reduced dimension stream and measuring the consistency in said samples or by measuring the pulp inlet rate and equating the washed pulp flow rate to the measured pulp inlet rate.

9. The process of claim 1 wherein step (b) comprises feeding said discharge stream on a conveyor belt moving in timed relation with said discharge stream to produce on the conveyor belt a stream wherein the transverse dimension ranges from about 12 inches to about 24 inches.

10. The process of claim 9 wherein step (d) comprises simultaneously measuring over the whole of the transverse dimension of the reduced dimension stream to determine the weight per unit length of said reduced dimension stream by use of weighing means supporting a section of said conveyor belt or a gamma gauge including gamma ray discharge means which discharges gamma rays in the direction of the reduced dimension stream on the belt and means to receive and count gamma rays passing through said stream and in step (e) determining the rate of movement in length per unit time from conveyor belt speed.

11. The process of claim 10 wherein step (d) also comprises measuring to determine the weight per unit length of said water constituent in said reduced dimension stream by measuring the capacitance in a selected length of said reduced dimension stream or by using a neutron gauge which discharges neutrons in the direction of the reduced dimension stream on the belt and includes means to receive and count neutrons passing through said stream.

12. The process of claim 11 wherein step (d) comprises measuring to determine the weight per unit length of said reduced dimension stream by using said gamma gauge and measuring to determine the weight per unit length of the water constituent in said reduced dimension stream using a neutron gauge.

13. The process of claim 10 wherein in step (e) either (A) washed pulp flow rate and water flow rate are determined from reduced dimension stream flow rate in weight per unit time and consistency determined based on obtaining samples from said discharge stream or from said reduced dimension stream or from said discharge stream and said reduced dimension stream and measuring the consistency in said samples or (B) washed pulp flow rate is determined by measurement of pulp inlet rate and equating the washed pulp flow rate to the measured pulp inlet rate and water flow rate is determined from said reduced dimension stream flow rate and the determined washed pulp flow rate.

14. The process of claim 9 wherein step (d) comprises simultaneously measuring over the whole transverse dimension of the reduced dimension stream to determine the weight per unit length of said water constituent in said reduced dimension stream by measuring the capacitance in a selected length of said reduced dimension stream or by using a neutron gauge, and step (e) comprises (i) measuring the conveyor belt speed to determine the water flow rate in length per unit time and determining the water flow rate in weight per unit time and (ii) determining washed pulp flow rate in weight per unit time either from said water flow rate in weight per unit time and consistency determined based on obtaining samples from said discharge stream or from said reduced dimension stream of from said discharge stream and said reduced dimension stream and measuring the consistency in said samples or by measuring the pulp inlet rate and equating the washed pulp flow rate to the measured pulp inlet rate.

15. A process as recited in claim 1 wherein the measurements in step (d) to determine weight per unit length and weight per unit volume are carried out using apparatus including means below said reduced dimension stream across its entire transverse dimension.

16. A method as recited in claim 1 using a single instrument to determine either weight per unit length or weight per unit volume of said reduced dimension stream and of said water constituent of said reduced dimension stream, said instrument containing computer means which subtracts the obtained data on water constituent from the data on reduced dimension stream to give a direct reading on washed pulp flow rate.

17. A process as recited in claim 1 wherein the washing process utilizes a diffusion type washer.

18. A process as recited in claim 1 wherein the washing process utilizes a Fourdrinier type washer.

* * * * *